US006514931B2

(12) United States Patent
Grainger et al.

(10) Patent No.: US 6,514,931 B2
(45) Date of Patent: Feb. 4, 2003

(54) FABRIC SOFTENING COMPOSITIONS

(75) Inventors: David Stephen Grainger, Wirral (GB); Andrew David Green, Wirral (GB); Mansur Sultan Mohammadi, Wirral (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/741,396

(22) Filed: Dec. 20, 2000

(65) Prior Publication Data

US 2001/0018410 A1 Aug. 30, 2001

(30) Foreign Application Priority Data

Dec. 22, 1999 (GB) ..... 9930435

(51) Int. Cl.[7] ..... C11D 1/835
(52) U.S. Cl. ..... 510/515
(58) Field of Search ..... 510/515, 516, 510/524, 527

(56) References Cited

U.S. PATENT DOCUMENTS 4,800,038 A * 1/1989 Broze et al. ..... 252/174.17

FOREIGN PATENT DOCUMENTS

GB 380406 A2 * 8/1990
WO WO 96/15213 * 5/1996
WO WO 98/16538 * 4/1998

* cited by examiner

*Primary Examiner*—John Hardee
(74) *Attorney, Agent, or Firm*—Ellen Plotkin

(57) ABSTRACT

The invention provides a fabric softening composition comprising;

(i) one or more cationic fabric softening compound(s) having two or more alkyl or alkenyl chains each having an average chain length equal to, or greater than, $C_8$, and (iv) at least one oily sugar derivative which is a liquid or soft solid derivative of a cyclic polyol or of a reduced saccharide, said derivative resulting from 35 to 100% of the hydroxyl groups in said polyol or in said saccharide being esterified or etherified, and wherein, the derivative has two or more ester or ether groups independently attached to a $C_8$–$C_{22}$ alkyl or alkenyl chain, and (v) a deposition aid comprising a mixture of one or more nonionic surfactant(s), and one or more one cationic polymer(s), and wherein the weight ratio of the nonionic surfactant to the cationic polymer is in the range 10:1 to 1:10.

The invention also provides a method of treating fabric with the above compositions.

7 Claims, No Drawings

FABRIC SOFTENING COMPOSITIONS

TECHNICAL FIELD

The present invention relates to fabric softening compositions comprising a mixture of particular oily sugar derivatives and cationic fabric softening compounds as softening compounds. The compositions give good fabric softening performance and good re-wetability on fabric even at high anionic material carry over levels. The invention also relates to a method of treating clothes with these compositions.

BACKGROUND AND PRIOR ART

Fabric softener compositions are well known in the art. However, a disadvantage associated with conventional fabric softeners is that although they increase the softness of a fabric they often simultaneously decrease its absorbency so that the ability of the fabric to take up water decreases. This is particularly disadvantageous with towels where the consumer requires the towel to be soft, and yet, have a high absorbency.

To overcome this problem it has been proposed to use fabric softening compositions comprising and oily sugar derivatives as softening compounds.

For example, WO 98/16538 (Unilever) discloses fabric softening compositions comprising liquid or soft solid derivatives of a cyclic polyol or a reduced saccharide which give good softening and retain absorbency of the fabric. Our co-pending UK patent application GB 9911437.3 discloses fabric softening compositions comprising liquid or soft solid derivatives of a cyclic polyol or a reduced saccharide, at least one anionic surfactant, and at least one cationic polymer.

Our co-pending UK patent application GB 9911434.0 discloses fabric softening compositions comprising liquid or soft solid derivatives of a cyclic polyol or a reduced saccharide having at least one unsaturated bond in the alkyl or alkenyl chains present, and a deposition aid and one or more antioxidants.

EP 0 380 406 (Colgate-Palmolive) discloses detergent compositions comprising a saccharide or reduced saccharide ester containing at least one fatty acid chain.

WO 95/00614 (Kao Corporation) discloses softening compositions comprising polyhydric alcohol esters and cationised cellulose.

U.S. Pat. No. 5,447,643 (Hüls) discloses aqueous fabric softeners comprising mono, di or tri fatty acid esters of certain nonionic surfactants (including esters of sucrose with degrees of esterification ranging from 1–4), and cationic protecting colloids.

WO 96/15213 (Henkel) discloses textile softening agents containing alkyl, alkenyl and/or acyl group containing sugar derivatives, which are solid after esterification, in combination with nonionic and cationic emulsifiers including cationic fabric softening compounds.

However to provide good deposition of the derivatives of a cyclic polyol or a reduced saccharide it is generally, necessary to include a deposition aid. cationic fabric softeners have been proposed for this use (see WO 98/16538 and GB 9911434.0 above). This may also be desirable to improve the appearance of the compositions. However, these, materials are particularly affected by even relatively low levels of anionic carry over from the wash liquor, and thus their effectiveness is frequently reduced. This is epecially problematic in countries where there is a high level of anionic carryover into the rinse step from the laundering step.

In case of moderate to high anionic carry over and/or for higher ratios of said derivative to said cationic softener (e.g. 55:45 and higher), the deposition of said derivative onto the fabric is reduced, typically resulting in reduced softening performance. This could be overcome by using more of the composition but this is undesirable on many grounds (e.g. environmental grounds and cost).

The present invention is directed toward overcoming the above-mentioned disadvantages, and in particular, to providing a composition that provides good softening of a fabric without simultaneously markedly decreasing absorbency across a range of anionic-carry over (from the wash) conditions and across a range of weight ratios of the derivatives of a cyclic polyol or a reduced saccharide to a cationic fabric softening compound.

It has been found that by the inclusion of a deposition aid comprising at least one nonionic surfactant and at least one cationic polymer in a weight ratio as described herein, the above effects are provided across a range of anionic carry over conditions and said weight ratios.

DEFINITION OF THE INVENTION

Thus according to one aspect of the invention there is provided a fabric softening composition comprising;

(i) one or more cationic fabric softening compound(s) having two or more alkyl or alkenyl chains each having an average chain length equal to, or greater than, $C_8$, and (ii) at least one oily sugar derivative which is a liquid or soft solid derivative of a cyclic polyol or of a reduced saccharide, said derivative resulting from 35 to 100% of the hydroxyl groups in said polyol or in said saccharide being esterified or etherified, and wherein, the derivative has two or more ester or ether groups independently attached to a $C_8$–$C_{22}$ alkyl or alkenyl chain, and (iii) a deposition aid comprising a mixture of one or more nonionic surfactant(s), and one or more one cationic polymer(s), and wherein the weight ratio of the nonionic surfactant to the cationic polymer is in the range 10:1 to 1:10.

According to a further aspect the present invention provides a method of treating fabric by applying thereto the above composition.

DETAILED DESCRIPTION OF THE INVENTION

The present invention provides a fabric softening composition comprising certain oily sugar derivatives, a cationic fabric softening compound, a nonionic surfactant and a cationic polymer, and wherein the weight ratio of the nonionic surfactant to the cationic polymer is in the range 10:1 to 1:10.

(i) Oily Sugar Derivative

The oily sugar derivative is a liquid or soft solid derivative of a cyclic polyol or of a reduced saccharide, said derivative resulting from 35 to 100% of the hydroxyl groups in said polyol or in said saccharide being esterified or etherified. The derivative has two or more ester or ether groups independently attached to a $C_8$–$C_{22}$ alkyl alkenyl chain.

The oily sugar derivatives of the invention are also referred to herein as "derivative-CP" and "derivative-RS" dependent upon whether the derivative is a product derived from a cyclic polyol or from a reduced saccharide starting material respectively.

Preferably the derivative-CP and derivative-RS contain 35% by weight tri or higher esters, e.g. at least 40%.

Preferably 35 to 85% most preferably 40 to 80%, even more preferably 45 to 75%, such as 45 to 70% of the hydroxyl groups in said cyclic polyol or in said reduced saccharide are esterified or etherified to produce the derivative-CP and derivative-RS respectively.

For the derivative-CP and derivative-RS, the tetra, penta etc prefixes only indicate the average degrees of esterification or etherification. The compounds exist as a mixture of materials ranging from the monoester to the fully esterified ester. It is the average-degree of esterification as determined by weight that is referred to herein.

The derivative-CP and derivative-RS used do not have substantial crystalline character at 20° C. Instead they are preferably in a liquid or soft solid state, as hereinbelow defined, at 20° C.

The starting cyclic polyol or reduced saccharide material is esterified or etherified with $C_8$–$C_{22}$ alkyl or alkenyl chains to the appropriate extent of esterication or etherification so that the derivatives are in the requisite liquid or soft solid state. These chains may contain unsaturation, branching or mixed chain lengths.

Typically the derivative-CP or derivative-RS has 3 or more, preferably 4 or more, for example 3 to 8, e.g. 3 to 5, ester or ether groups or mixtures thereof. It is preferred if two or more of the ester or ether groups of the derivative-CF and derivative-RS are independently of one another attached to a $C_8$ to $C_{22}$ alkyl or alkenyl chain. The alkyl or alkenyl groups may be branched or linear carbon chains.

The derivative-CPs are preferred for use as the oily sugar derivative. Inositol is a preferred cyclic polyol, and Inositol derivatives are especially preferred.

In the context of the present invention the terms derivative-CP and derivative-RS encompass all ether or ester derivatives of all forms of saccharides, which fall into the above definition, and are especially preferred for use. Examples of preferred saccharides for the derivative-CP and derivative-RS to b e derived from are monosaccharides and disaccharides.

Examples of monosaccharides include xylose, arabinose, galactose, fructose, sorbose and glucose. Glucose is especially preferred. An example of a reduced saccharide is sorbitan. Examples of disaccharides include maltose, lactose, cellobiose and sucrose. Sucrose is especially preferred.

If the derivative-CF is based on a disaccharide it is preferred if the disaccharide has 3 or more ester or ether groups attached to it. Examples include sucrose tri, tetra and penta esters.

Where the cyclic polyol is a reducing-sugar it is advantageous if each ring of the derivative-CP has one ether group, preferably at the $C_1$ position. Suitable examples of such compounds include methyl glucose derivatives.

Examples of suitable derivative-CPs include esters of alkyl(poly)glucosides, in particular alkyl-glucoside esters having a degree of polymerisation from 1 to 2.

The HLB of the derivative-CP and derivative-RS is typically between 1 and 3.

The derivative-CP and derivative-RS may have branched or linear alkyl or alkenyl chains (of varying degrees of branching), mixed chain lengths and/or unsaturation. Those having unsaturated and/or mixed alkyl chain lengths are preferred.

One or more of the alkyl or alkenyl chains (independently attached to the ester or ether groups) may contain at least one unsaturated bond.

For example, predominantly unsaturated fatty chains may be attached to the ester/ether groups, e.g. those attached may be derived from rape oil, cotton seed oil, soybean oil, oleic, tallow, palmitoleic, linoleic, erucic or other sources of unsaturated vegetable fatty acids.

The alkyl or alkenyl chains of the derivative-CP and derivative-RS are preferably predominantly unsaturated, for example sucrose tetratallowate, sucrose tetrarapeate, sucrose tetraoleate, sucrose tetraesters of soybean oil or cotton seed oil, cellobiose tetraoleate, sucrose trioleate, sucrose triapeate, sucrose pentaoleate, sucrose pentarapeate, sucrose hexaoleate, sucrose hexarapeate, sucrose triesters, pentaesters and hexaesters of soybean oil or cotton seed oil, glucose trioleate, glucose tetraoleate, xylose trioleate, or sucrose tetra-,tri-,penta- or hexa-esters with any mixture of predominantly unsaturated fatty acid chains.

However some derivative-CPs and derivative-RSs may be based on alkyl or alkenyl chains derived from polyunsaturated fatty acid sources, e.g. sucrose tetralinoleate. It is preferred that most, if not all, of the polyunsaturation has been removed by partial hydrogenation if such polyunsaturated fatty acid chain are used.

The most highly preferred liquid derivative-CPs and derivative-RSs are any of those mentioned in the above three paragraphs but where the polyunsaturation has been removed through partial hydrogenation.

Especially good results are obtained when the alkyl and/or alkenyl chains of the derivative-CPs and derivative-RSs are obtained by using a fatty acid mixture (to react with the starting cyclic polyol or reduced saccharide) which comprises a mixture of tallow fatty acid and oleyl fatty acid in a weight ratio of 10:90 to 90:10, more preferably 25:75 to 75:25, most preferably 30:70 to 70:30. A fatty acid mixture comprising a mixture of tallow fatty acid and oleyl fatty acid in a weight ratio of 60:40 to 40:60 is most preferred.

Especially preferred are fatty acid mixtures comprising a weight ratio of approximately 50 wt % tallow chains and 50 wt % oleyl chains. It is especially preferred that the fatty acid mixture consists only of a mixture of tallow fatty acid and oleyl fatty acid.

Preferably 40% or more of the chains contain an unsaturated bond, more preferably 50% or more, most preferably 60% or more e.g. 65% to 95%.

Other oily sugar derivatives suitable for use in the compositions include sucrose pentalaurate, sucrose pentaerucate and sucrose tetraerucate Suitable materials include some of the Ryoto series available from Mitsubishi Kagaku Foods Corporation.

The liquid or soft solid derivative-CPs and derivative-RSs are characterised as materials having a solid:liquid ratio of between 50:50 and 0:100 at 20° C. as determined by $T_2$ relaxation time NMR, preferably between 43:57 and 0:100, most preferably between 40:60 and 0:100, such as, 20:80 and 0:100. The $T_2$ NMR relaxation time is commonly used for characterising solid:liquid ratios in soft solid products such as fats and margarines. For the purpose of the present invention, any component of the NMR signal with a $T_2$ of less than 100 microsecond is considered to be a solid component and any component with $T_2$ greater than 100 microseconds is considered to be a liquid component.

The liquid or soft solid derivative-CPE and derivative-RSE can be prepared by a variety of methods well known to those skilled in the art. These methods include acylation of the cyclic polyol or of a reduced saccharide with an acid chloride; trans-esterification of the cyclic polyol or of a reduced saccharide material with short chain fatty acid esters in the presence of a basic catalyst (e.g. KOH); acylation of the cyclic polyol or of a reduced saccharide with an acid anhydride, and, acylation of the cyclic polyol or of a reduced saccharide with a fatty acid. Typical preparations of these materials are disclosed in U.S. Pat. No. 4,386,213 and AU 14416/88 (Procter and Gamble).

The compositions preferably comprise between 0.5%–30% wt of the oily sugar derivatives, more preferably 1–20% wt, most preferably 1.5–20% wt, e.g. 3–15% wt %, based on the total weight of the composition.

(ii) Cationic Fabric Softening Compounds

The compositions comprise one or more cationic fabric softening compound(s) having two or more alkyl or alkenyl chains each having an average chain length equal to, or greater than $C_8$, especially $C_{12-28}$ alkyl or alkenyl chains connected to a nitrogen atom. The alkyl or alkenyl groups are preferably connected via at least one ester link, more preferably via two or more ester linkages.

The cationic fabric softening compounds may be ester-linked quaternary ammonium fabric softening compounds or non-ester linked quaternary ammonium fabric softening compounds. The ester-linked quaternary ammonium fabric softening compounds are herein referred to as "the ester-softening compound". The non-ester linked quaternary ammonium fabric softening compounds are herein referred to as "the non-ester softening compound".

Especially suitable compounds have two or more alkyl or alkenyl chains each having an average chain length equal to, or greater than $C_{14}$, more preferably, equal to or greater $C_{16}$. Most preferably at least 50% of the total number of alkyl or alkenyl chains have a chain length equal to, or greater than $C_{18}$.

It is advantageous for environmental reasons if the ester-softening compound is biologically degradable. It is also preferred if the alkyl or alkenyl chains of the ester-softening compound are predominantly linear.

One preferred type of ester-softening compound is a quaternary ammonium material represented by formula (I):

(I)

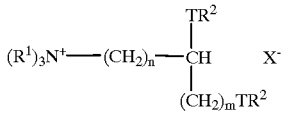

wherein T is

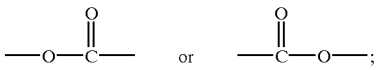

each $R^1$ group is independently selected from $C_{1-4}$, alkyl or hydroxyalkyl or $C_{2-4}$ alkenyl groups; and wherein each $R^2$ group is independently selected from $C_{8-28}$ alkyl or alkenyl groups, $X^-$ is any suitable anion including a halide, acetate or lower alkosulphate ion, such as chloride or methosulphate, n is O organ integer from 1–5, and m is from 1–5.

Preferred materials of this class such as 1,2 bis[hardened tallowoyloxy]-3- trimethylammonium propane chloride and their method of preparation are, for example, described in U.S. Pat No. 4,137,180 (Lever Brothers). Preferably these materials comprise small amounts of the corresponding monoester as described in U.S. Pat No. 4,137,180 for example 1-hardened tallowoyloxy -2-hydroxy 3-trimethylammonium propane chloride.

A second preferred type of ester-softening compound is represented by the formula (II):

(II)

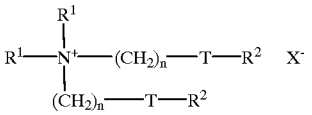

wherein T, $R^1$, $R^2$, n, and $X^-$ are as defined above.

In this class di(tallowoyloxyethyl) dimethyl ammonium chloride and methyl bis-[ethyl (tallowoyl)]-2-hydroxyethyl ammonium methyl sulphate are especially preferred._._ The tallow chains in these compounds may be hardened and may even be fully unsaturated, i.e. preferred compounds also include di(hardened tallowoyloxy ethyl)-dimethyl ammonium chloride and methyl bis-[ethyl(hardened tallowoyl)]-2-hydroxyethyl ammonium methyl sulphate. Commercially available compounds include those in the Tetranyl range (ex Kao) and Stepantex range (ex Stepan).

Also suitable are derivatives of the above formula where one or more of the $(CH_2)_n$ chain(s) has at least one pendent alkyl chain e.g. a methyl chain. Examples include the cationic quaternary ammonium compounds described in WO 99/35223 and WO 99/35120 (Witco)

A third preferred type of ester-softening compound is a quaternary ammonium material represented by the formula (III):

(III)

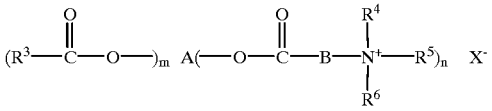

wherein $X^-$ is as defined above, A is an (m+n) valent radical remaining after the removal of (m+n) hydroxy groups from an aliphatic polyol having p hydroxy groups and an atomic ratio of carbon to oxygen in the range of 1.0 to 3.0 and up to 2 groups per hydroxy group selected from-ethylene oxide and propylene oxide, m is 0 or an integer from 1 to p-n, n is an integer from 1 to p-m, and p is an integer of at least 2, B is an alkylene or alkylidene group containing 1 to 4 carbon atoms, $R^3$, $R^4$, $R^5$ and $R^6$ are, independently from each other, straight or branched chain $C_1$–$C_{48}$ alkyl or alkenyl groups, optionally with substitution by one or more functional groups and/or interruption by at most 10 ethylene oxide and/or propylene oxide groups, or by at most two functional groups selected from;

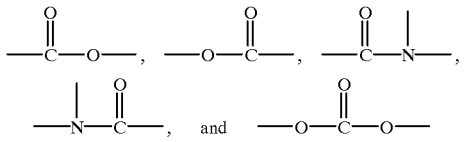

or $R^4$ and $R^5$ may form a ring system containing 5 or 6 atoms in the ring, with the proviso that the average compound either has at least one R group having 22–48 carbon atoms, or at least two R groups having 16–20 carbon atoms, or at least three R groups having 10–14 carbon atoms. Preferred compounds of this type are described in EP 638 639 (Akzo).

The non-ester softening compound preferably has the alkyl or alkenyl chain lengths referred to above (in respect of the non-ester softening compounds).

One preferred type of non-ester softening compound is a quaternary ammonium material represented by formula (IV):

(IV)

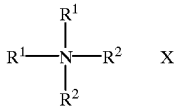

wherein each $R^1$ group is independently selected from $C_{1-4}$ alkyl, hydroxyalkyl or $C_{2-4}$ alkenyl groups; each $R^2$ group is independently selected from $C_{8-28}$ alkyl or alkenyl groups, and $X^-$ is as defined above.

A preferred material of formula (IV) is di-hardened tallow-dimethyl ammonium chloride, sold under the Trademark ARQUAD 2HT by Akzo Nobel.

The compositions preferably comprise a total amount of between 0.5% wt–30% by weight of the cationic fabric softening compounds, preferably 1%–25%, more preferably 1.5–22%, most preferably 2%–20%, based on the total weight of the composition.

The compositions may comprise predominantly the oily sugar derivative or predominantly the cationic softener with respect to the mixture of these two components. The weight ratio may be as high as 150:1 for either component relative to the other.

The weight ratio of the cationic fabric softening compound to the oily sugar derivatives is preferably in the range 90:1 to 1:90, more preferably 50:1 to 1:50. If a derivative rich mixture is used then the weight ratio of derivative to softening compound will preferably be up to 30:1. If a cationic softener rich mixture is used then the ratio will preferably be up to 30:1 for the softener. However for some mixed active systems a ratio in the range 10:1 to 1:10, more, preferably 5:1 to 1:2, e.g. 4:1 to 1:1 based on the softener-:derivative weight ratio may be used.

If the oily sugar derivative or quaternary ammonium softening compound comprises hydrocarbyl chains formed from fatty acids or fatty acyl compounds which are unsaturated or at least partially unsaturated (e.g. having an iodine value of from 5 to 140, preferably 5 to 100, more preferably 5 to 60, most preferably 5 to 40, e.g. 5 to 25), then the cis:trans isomer weight ratio in the fatty acid/fatty acyl compound is greater than 20/80, preferably greater than 30/70, more preferably greater than 40/60, most preferably greater than 50/50, e.g. 70/30 or greater. It is believed that higher cis:trans isomer weight ratios afford the compositions comprising the compound better low temperature stability and minimal odour formation. Suitable fatty acids include Radiacid 406, ex Fina.

Saturated and unsaturated fatty acids/acyl compounds may be mixed together in varying amounts to provide a compound having the desired iodine value.

Fatty acids/acyl compounds may also be, at least partially hydrogenated to achieve lower iodine values.

Of course, the cis:trans isomer weight ratios can be controlled during hydrogenation by methods known in the art such as by optimal mixing, using specific catalysts and providing high $H_2$ availability.

(iii) Deposition Aid Mixture

In the context of the present invention a deposition aid is defined as a material that aids deposition of the oily sugar derivative onto a fabric during the laundering process.

The compositions comprise a deposition aid mixture which comprises a mixture of one or more nonionic surfactant(s) and one or more cationic polymers in a weight ratio of 1:10 to 10:1.

(a) Nonionic Surfactant

Preferably the nonionic surfactant has a single $C_8$–$C_{28}$ alkyl or alkenyl chain, most preferably a single $C_8$–$C_{20}$ alkyl or alkenyl chain, more preferably a single $C_{10}$–$C_{18}$ alkyl or alkenyl chain. It is especially preferred that the nonionic surfactant is an alkoxylated surfactant, especially an ethoxylated surfactant.

Suitable nonionic surfactants include the condensation, products of $C_8$–$C_{30}$ primary or secondary linear or branched alcohols preferably C10–$C_{22}$ alcohols, alkoxylated with 10 or more moles of alkylene oxide, preferably 10–25 moles of alkylene oxide, more preferably between 15 and 20 moles of alkylene oxide. Preferably the alkylene oxide is ethylene oxide although it may be/include propoxylate groups. The alcohols may be saturated or unsaturated.

Suitable alcohol ethoxylates include the condensation products of coconut fatty alcohol with 15–20 moles of ethylene oxide, e.g. Coco 20 ethoxylate, and, condensation products of tallow alcohol with 10–20 moles of ethylene oxide , e.g. tallow 15 ethoxylate. Other suitable examples include alkyl poly glucosides and other sugar based surfactants e.g. ethoxylated sorbitans.

The nonionic surfactants preferably have an HLB of from about 10 to about 20, for example from 11 to 16.

The nonionic surfactant is preferably present in an amount of 0.01 to 5% by weight, preferably 0.05%–3%, more preferably 0.1%–2%, based on the total weight of the composition.

(b) Cationic Polymeric Deposition Aid

The compositions comprise one or more one cationic polymers.

Suitable cationic polymers include cationic guar polymers such as; the JAGUAR® series of polymers (ex Rhodia), cationic cellulose derivatives such as CELQUATS® (ex National Starch), UCARE® polymer (ex Amerchol), cationic starches e.g. potato starch such as SOFTGELS®, e.g. BDA, and BD (both ex Avebe) and the C* bond polymers series from Cerestar, AMYLOFAX® and SOLVITOSE® polymers (both ex Avebe), POLYGEL polymers K 100 and K200 (ex Sigma), cationic polyacrylamides such as PCG (ex Allied Colloids) and FLOCAID® series of polymers (ex National Starch) and cationic chitosan derivatives.

Cationic deflocculating polymers, e.g. as described in EP 415 698 and EP 458 599 may also be used.

It is especially preferred that the cationic polymer is selected from cationic starch, cationic cellulose, cationic guar, cationic chitosan derivatives and cationic decoupling polymers.

The cationic polymers may be present in the compositions in an amount of 0.01 to 5% by weight based upon the total weight of the composition, more preferably 0.02–3.5%, such as 0.5–2.5%.

The weight ratio of the nonionic surfactant to the cationic polymer is in the range 10:1 to 1:10, preferably the range 5:1 to 1:5. Particularly good results are obtained with high levels of the polymer, that is 1.5:1 to 1:3.

It has been found that the polymer helps to improve the appearance of the product.

Water

The compositions preferably contain water in an amount of at least 50% by weight, more preferably at least 60%, for example at least 70%, based on the total weight of the composition.

Optional Ingredients

Especially preferred optional ingredients are antioxidants. The compositions preferably comprise one or more antioxidants to reduce any malodour that may form upon storage, e.g. in an amount of 0.0001% to 1% by weight (in total). Preferably the antioxidant comprises at least one initiation inhibitor antioxidant and/or at least one propagation inhibitor as described in our co-pending application number GB 9911434.0. Mixtures of these two types of antioxidants have been found to be particularly beneficial, especially in reducing medium to long term malodour.

The compositions may also contain fatty acids, for example $C_8$–$C_{24}$ alkyl or alkenyl monocarboxylic acids, or, polymeric carboxylic acids. Preferably saturated fatty acids are used, in particular, hardened tallow $C_{16}$–$C_{18}$ fatty acids.

Nonionic polymers may also be included.

The compositions may comprise one or more one cationic surfactants having a single $C_8$–$C_{28}$ alkyl or alkenyl chain, preferably a single $C_8$–$C_{20}$ alkyl or alkenyl chain, most preferably a single C10–$C_{18}$ alkyl or alkenyl chain.

Examples include water soluble single chain quaternary ammonium compounds such as cetyl trimethyl ammonium chloride, cetyl trimethyl ammonium bromide, or any of those listed in European Patent No. 258 923 (Akzo). For example the cationic surfactant may be an alkyl trimethylammonium methosulphate or chloride or alkyl ethoxylalkyl ammonium methosulphate or chloride. Examples include coconut pentaethoxymethyl ammonium methosulphate and derivatives in which at least two of the methyl groups on the nitrogen atom are replaced by (poly) alkoxylated groups.

Preferably, the cation in the cationic surfactant is selected from alkyl tri-methylammonium methosulphates and their derivatives, in which, at least two of the methyl groups on the nitrogen atom are replaced by (poly)alkoxylated groups.

Any suitable counter-ion may be used in the cationic surfactant. Preferred counter-ions include halogens (especially chlorides), methosulphate, ethosulphate, tosylate, phosphate and nitrate.

Suitable commercially available cationic surfactants include the Ethoquad range from Akzo, e.g. Ethoquad 0/12 and Ethoquad HT/25.

The cationic surfactant is preferably present in an amount of 0.01% to 5% by weight, preferably 0.05%–3%, more preferably 0.1%–2% based on the total weight of the composition.

Amphoteric and zwitterionic surfactants may also be used. Preferred types include amine oxides, betaines including sulphobetaines and tegobetaines, phosphine oxides and sulphoxides e.g. coco amido propyl betaine.

Suitable amine oxides include those containing one alkyl moiety of from about 10 to about 18 carbon atoms and 2 moieties selected from the group consisting of alkyl groups and hydroxyalkyl groups containing from about 1 to about 3 carbon atoms e.g. alkyl amine oxide; water-soluble phosphine oxides containing one alkyl moiety of from about 10 to about 18 carbon atoms and 2 moieties selected from the groups consisting of alkyl groups and hydroxyalkyl groups containing from about 1 to about 3 carbon atoms; and water-soluble sulfoxides containing one alkyl moiety of from about 10 to about 18 carbon atoms and a moiety selected from the groups consisting of alkyl and hydroxyalkyl moieties of from about 1 to about 3 carbon atoms.

Typically the compositions will comprise one or more perfumes conventionally used in fabric softening compositions.

The composition may also contain one or more optional ingredients, selected from dyes, preservatives, electrolytes, non-aqueous solvents, pH buffering agents, perfume carriers, fluorescers, hydrotropes, antifoaming agents, antiredeposition agents, enzymes, optical brightening agents, opacifiers, anti-shrinking agents, anti-wrinkle agents, anti-spotting agents, germicides, fungicides, anti-corrosion agents, drape imparting agents, antistatic agents, sunscreens, colour care agents and ironing aids.

Method of Making the Compositions

The compositions may be made by any suitable method.

If the compositions comprise more than about 0.5 wt % of the cationic softener it is especially preferred that the compositions are prepared by a method that includes the step wherein the cationic softening compound and/or the oily sugar derivative is/are separately mixed with another active component of the fabric softening composition to form a pre-mixture prior to the admixing of the softening compound with the oily sugar derivative to produce the fabric softening composition. The pre-mixing with another active component to form a pre-mixture prior to said admixing may apply to either the softening compound or the oily sugar derivative or to both.

The term "active component" as used herein defines a component of the compositions which has a functional role therein and which is supplied as a separate raw material product. The term includes nonionic and cationic surfactants and perfumes. The term does not include water, dyes, preservatives or any of the minor optional ingredients recited herein. Preferably both the derivative and the softening compound are pre-mixed in this manner.

The active component is preferably a cationic surfactant having a single $C_8$–$C_{28}$ alkyl or alkenyl chain, a nonionic surfactant or a perfume.

However, the term "active-component" does not include where a component raw material is supplied with a minor amount of an "active component" included as part of that raw material as obtained from the manufacturer. Thus, for example, a cationic fabric softening compound raw material (supplied as comprising a minor amount of a surfactant) mixed directly with an oily sugar derivative raw material in the absence of another "active component" raw material as defined above, would not form part of the preferred method.

The separate pre-mixing of the softening compound and/or the oily sugar-derivative with another active component of the fabric softening composition to form said pre-mixture may occur in any known manner.

The method may incorporate one or more of the following ways of forming the pre-mixture(s).

According to one preferred method the oily sugar derivative is pre-mixed with water and/or with at least one cationic surfactant having a single $C_8$–$C_{28}$ alkyl or alkenyl chain, and/or nonionic surfactant, to form a pre-mixture and subsequently the softening compound, in at least partially liquid or molten state, is mixed with said pre-mixture.

For this method, the pre-mixture formed from the oily sugar derivative is preferably at a temperature of at least 30° C., preferably at least 40° C., most preferably at least 50° C. when the softening compound is mixed therewith. However the resultant mixture obtained from the pre-mixture and the softening compound being-mixed together may subsequently be heated to said temperature.

According to another preferred method, the softening compound is pre-mixed with water and/or with at least one cationic surfactant having a single $C_8$–$C_{28}$ alkyl or alkenyl chain, and/or a nonionic surfactant, to form a pre-mixture and subsequently the oily sugar derivative is mixed with said pre-mixture.

For this method it is especially preferred that the softening compound is pre-mixed with at least one nonionic surfactant either alone or in the presence of water.

It is especially preferred that if optional minor ingredients which are polyelectrolytes are present, such as preservative, these are added after the oily sugar derivatives and the softening compound have been brought into contact. If these components are added before this occurs then the compositions may not be stable and/or complexation of the oily sugar derivatives and the softening compound may occur.

Product Form

The compositions of the invention may be in any physical form including gels, liquids, powders and granules. Liquids, especially emulsions, are preferred. Emulsion compositions are particularly preferred.

Method of Treating Fabrics

The invention also provides a method of treating fabrics by applying thereto the compositions of the invention. The compositions can by applied to the fabric by any suitable method. The preferred methods are by treatment of the fabric during a domestic laundering process such as by soaking, or, in the rinse cycle of a domestic washing machine.

EXAMPLES

The invention is further illustrated by the following non-limiting examples. Further examples within the scope of the present invention will be apparent to the man skilled in the art.

All percentages in the following examples are by weight based upon the total weight of the composition and are given as the percentage of the active ingredient unless a '% solution' is indicated in which case the value given is the amount of that solution added. The examples according to the invention are denoted by numbers. The comparative examples are denoted by letters.

The compositions in Table 1 were prepared by adding (3) to hot water (70° C.) and mixing. A co-melted mixture of (1), and the nonionic surfactant was added thereto. Finally the polymer was added as a 5 wt % solution in water.

TABLE 1

All amounts are percentages by weight

| | 1 | A | 2 | B |
|---|---|---|---|---|
| Cationic softener (1) | 2.5 | 2.5 | 1.25 | 1.25 |
| Cationic Polymer (2) 5% wt solution | 10 | — | 15 | — |
| Sucrose tetraerucate (3) | 2.5 | 2.5 | 3.75 | 3.75 |
| Nonionic Surfactant Coco 20EO | 0.5 | 0.5 | 0.75 | 0.75 |
| Perfume | 0.3 | 0.3 | 0.3 | 0.3 |
| Water | To 100% | To 100% | To 100% | To 100% |

(1) 1, 2 bis [hardened tallowoyloxy]-3-trimethylammonium propane chloride, (78.5% active composition) available from Clariant.
(2) Softgel BDA - a cationically modified potato starch (ex Avebe), added as a 5% solution in water.
(3) available from Mitsubishi Kagaku Corporation, Japan as Ryoto ER 290. It contains predominantly tetra, penta and hexa erucate.

Evaluation of Softening Performance

The softening performance in a range of anionic carry over conditions was tested for the above examples. The softening performance was evaluated by adding 0.1 g of the compound (2 m of a 5 wt dispersion) to 1 litre of tap water, at ambient temperature in a tergotometer. The stated number of mls of a 1 wt % alkyl benzene sulphonate solution was added to simulate anionic surfactant carried over from the main wash.

Three pieces of terry towelling (20 cm×20 cm, 40 g total weight) were added to the tergotometer pot. The cloths were treated for 5 minutes at 65 rpm, spin dried to remove excess liquor and line dried overnight and conditioned at 21 ° C. and 65% relative humidity for 24 hours., Softening of the fabrics was assessed by an expert panel of 4 people using a round robin paired comparison tests protocol. Each panel member assessed four sets of test cloths. Each set of test cloths contained one cloth of each, test system under evaluation. Panel members were asked to assess softness on an 8-point scale (8=very harsh, 2=very soft). Softness scores were calculated using an "Analysis, of Variance" technique. Lower values indicate better softening as assessed by the panellists.

The results are given in Table 2.

TABLE 2

Softening performance of Products in Table 1

| No. mls 1 wt % anionic carry-over | 1 | A | 3 | B |
|---|---|---|---|---|
| 0 | 3.5 | 4 | 4.25 | 4.5 |
| 1 | 4.5 | 4 | 4 | 5.5 |
| 2 | 4.25 | 5.25 | 4.75 | 5.75 |

The above results demonstrate that in the absence of polymer, example A having a weight ratio of cationic softener to sucrose tetraerucate of 1:3 doesn't soften as well as example B (for which the ratio is 1:1), even at low carry-over levels.

However by the addition of polymer performance is maintained, across the aforementioned ratio range (see Examples 1 and 2).

Formulated Compositions

Numbers are as percentages by weight. All examples were made by adding the oily sugar derivative, cationic polymer to water and adding thereto a co-melt of the cationic surfactant and the nonionic surfactant., The perfume was added last.

TABLE 3

Formulated compositions.

| | C | 3 | 4 | 5 | 6 |
|---|---|---|---|---|---|
| Nonionic surfactant (4) | 0.5 | 0.5 | 0.5 | 0.5 | 0.5 |
| Cationic polymer (2% solution) (5) | 50.0 | 50.0 | 50.0 | 50.0 | 50.0 |
| Sucrose polyerucate (3) | 4.5 | 4.5 | 4.5 | 4.5 | 4.5 |
| Preservative | 0.07 | 0.07 | 0.07 | 0.07 | 0.07 |
| Dye (1% solution) | 0.06 | 0.06 | 0.06 | 0.06 | 0.06 |
| Perfume | 0.32 | 0.32 | 0.32 | 0.32 | 0.32 |
| Cationic softener (6) | — | 0.05 | 0.03 | — | — |
| Cationic softener (7) | — | — | — | 0.03 | — |
| Cationic softener (8) | — | — | — | — | 0.05 |
| water | 44.55 | 44.55 | 44.55 | 44.55 | 44.55 |

TABLE 3-continued

| | Formulated compositions. | | | | |
|---|---|---|---|---|---|
| | C | 3 | 4 | 5 | 6 |
| Weight ratio of (3):(4) | 9.00 | 9.00 | 9.00 | 9.00 | 9.00 |
| Weight ratio of (3):(6), (7), (8). | — | 90.00 | 150.00 | 150.00 | 90.00 |
| viscosity (1-day) mPa · S | 24.17 | 55.31 | 55.29 | 46.26 | |
| refractive index | 1.33481 | 1.33348 | 1.33523 | 1.33471 | 1.33444 |

(3) see above.
(4) Synperonic A7 fatty alcohol ethoxylate available from ICI.
(5) 2 wt % solution of polymer (2) above
(6) Unsaturated Di(tallowoyloxyethyl) dimethyl ammonium chloride available from Witco.
(7) methyl bis-[ethyl (tallowyl)]-2-hydroxyethyl ammonium methyl sulphate available as TEA Rewoquat (ex Witco).
(8) Saturated Di(tallowoyloxyethyl) dimethyl ammonium chloride Kao as Kaosoft PH.

TABLE 4

Formulated compositions.
Numbers are as percentages by weight. The examples were made as described for table 3.

| | 7 | 8 | 9 |
|---|---|---|---|
| Nonionic surfactant (4) | 0.5 | 0.5 | 0.5 |
| Cationic polymer (2% solution) (5) | 50 | 50 | 50 |
| Sucrose polyerucate (3) | 4 | 3.5 | 3.5 |
| Preservative | 0.07 | 0.07 | 0.07 |
| Dye (1% solution) | 0.06 | 0.06 | 0.06 |
| Perfume | 0.32 | 0.32 | 0.32 |
| Cationic softener (6) | — | — | 0.1 |
| Cationic softener (7) | 0.05 | 0.1 | — |
| Fatty acid 5166 21% unsat | 0.45 | 0.9 | 0.9 |
| Water | To 100% | To 100% | To 100% |
| Weight ratio of (3):(4) | 8.00 | 7.00 | 7.00 |
| Weight ratio of (3):(6), (7). | 80.00 | 35.00 | 35.00 |
| Viscosity (1-day) mPa · s | 41.27 | 86.44 | — |

(3), (4), (5), (6), (7) see above

TABLE 5

Formulated compositions.
Numbers are as percentages by weight. The examples were made as described for table 3.

| | 10 | 11 | 12 |
|---|---|---|---|
| Sucrose polyerucate (3) | 15 | 23.2 | 22.2 |
| Nonionic surfactant Coco 15EO | 2 | 2 | 2 |

TABLE 5-continued

Formulated compositions.
Numbers are as percentages by weight. The examples were made as described for table 3.

| | 10 | 11 | 12 |
|---|---|---|---|
| Cationic Polymer (2) | 2 | 2 | 2 |
| Cationic softener (1) | 1 | 1 | 2 |
| Alkyl benzene sulphonate | 0.1 | 0.2 | 0.2 |
| Perfume | 0.42 | 0.68 | 0.68 |
| Dye | .0025 | 0.0025 | 0.0025 |
| Water | To 100% | To 100% | To 100% |

(1), (2), (3) see above

Tables 6 and 7 show the softening performance against commercially available products. The softness scores were measured as above and the anionic carry over strengths and rinse cycle times are given below. Comparative Example D is a dilute, commercially available fabric softener.

TABLE 6 softening results

| Example No. | Softness Ranking Scores |
|---|---|
| Example 3 | 5.62 |
| Example 5 | 4.25 |
| Example 7 | 5.75 |
| Example 9 | 5.37 |
| Comparative D | 5.62 |

Carry over = 3 ml of 1% ABS solution.
Rinse cycle time = 5 minutes

TABLE 7 softening results

| | Softeness Ranking Scores |
|---|---|
| Example 8 | 5.5 |
| Example 9 | 4.25 |
| Example 10 | 4.0 |
| Example 11 | 4.0 |
| Example 12 | 4.0 |
| Comparative E | 3.87 |

Anionic Carryover = 10 ml of a 10% Tide Ultra solution.
Rinse cycle time = 2.5 minutes.
Comparative Example E is a concentrated, commercially available fabric softener.

What is claimed is:

1. A fabric softening composition comprising;

(i) one or more cationic fabric softening compound(s) having two or more alkyl or alkenyl chains each having an average chain length equal to, or greater than, $C_8$, and (ii) about 0.5% to about 30% wt of at least one oily sugar derivative which is a liquid or soft solid derivative of a cyclic polyol or of a reduced saccharide, said derivative resulting from 35 to 100% of the hydroxyl groups in said polyol or in said saccharide being esterified or etherified, and wherein, the derivative has two or more ester or ether groups independently attached to a $C_8$–$C_{22}$ alkyl or alkenyl chain, and (iii) a deposition aid comprising a mixture of one or more nonionic surfactant(s), and one or more cationic polymer(s);

wherein said nonionic surfactant is selected from the group consisting of condensation products of C8–C30 primary or secondary linear or branched alcohols alkoxylated with 10 or more moles of alkylene oxide; wherein said nonionic surfactant comprises 0.01 to 5% wt based on the total weight of the composition;

wherein said cationic polymer is selected from the group consisting of cationic starch, cationic cellulose derivatives, cationic guar, cationic chitosan derivatives, cationic polyacrylamides, and mixtures thereof; and wherein the weight ratio of said nonionic surfactant to said cationic polymer is 10:1 to 1:10.

2. A composition according to claim 1 wherein the weight ratio of the nonionic surfactant to the cationic polymer is in the range 5:1 to 1:5.

3. A composition according to claim 1 wherein the cationic fabric softening compound is a quaternary ammonium compound having two or three $C_{12-28}$ alkyl or alkenyl chains.

4. A composition according to claim 1, wherein the composition comprises between 0.5% wt–30% wt of the cationic fabric softening compounds, based on the total weight of the composition.

5. A composition according to claim 1, wherein the nonionic surfactant has a single $C_8$–$C_{28}$ alkyl or alkenyl chain.

6. A composition according to claim 1, wherein the composition comprises between 0.01 to 5% wt of the cationic polymer, based on the total weight of the composition.

7. A method of treating fabric by applying thereto the composition of claim 1.

* * * * *